US007204314B2

(12) United States Patent
Lauritzen et al.

(10) Patent No.: US 7,204,314 B2
(45) Date of Patent: Apr. 17, 2007

(54) FLUID REMOVAL FROM GAS WELLS

(75) Inventors: J. Eric Lauritzen, Cypress, TX (US); Neil Andrew Abercrombie Simpson, Aberdeen (GB); Colin Gordon Rae, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 284 days.

(21) Appl. No.: 10/720,837

(22) Filed: Nov. 21, 2003

(65) Prior Publication Data

US 2004/0144545 A1 Jul. 29, 2004

(30) Foreign Application Priority Data

Nov. 23, 2002 (GB) ..... 0227394.4

(51) Int. Cl.
*E21B 43/38* (2006.01)

(52) U.S. Cl. ..... 166/369; 166/105.6; 166/263; 166/266

(58) Field of Classification Search ..... None
See application file for complete search history.

(56) References Cited

U.S. PATENT DOCUMENTS

| | | | | |
|---|---|---|---|---|
| 3,548,939 | A | 12/1970 | Bennett | |
| 4,565,496 | A * | 1/1986 | Soderberg | 417/46 |
| 5,950,651 | A | 9/1999 | Kenworthy et al. | |
| 6,026,904 | A * | 2/2000 | Burd et al. | 166/313 |
| 6,234,770 | B1 | 5/2001 | Ridley et al. | |
| 6,592,334 | B1 | 7/2003 | Butler | |
| 6,691,781 | B2 * | 2/2004 | Grant et al. | 166/265 |
| 2003/0085036 | A1 | 5/2003 | Curtis et al. | |
| 2004/0031622 | A1 | 2/2004 | Butler et al. | |

FOREIGN PATENT DOCUMENTS

| | | |
|---|---|---|
| GB | 2 257 449 | 1/1993 |
| GB | 2 342 670 | 4/2000 |
| GB | 2 370 302 | 6/2002 |

OTHER PUBLICATIONS

U.K. Search Report, Application No. GB0510725.5, dated Jul. 25, 2005.
U.K. Search Report Application No. GB 0327268.9, dated Dec. 15, 2004.
U.K. Examination Report, Application No. GB 0327268.9, dated Mar. 22, 2004.

* cited by examiner

*Primary Examiner*—Zakiya W. Bates
(74) *Attorney, Agent, or Firm*—Patterson & Sheridan, L.L.P.

(57) ABSTRACT

A method of removing produced fluid from a well producing both gas and liquid comprises utilising produced gas flowing from a formation to power a produced liquid pump. The produced liquid from the pump and the produced gas are carried towards surface in separate fluid streams, and may be commingled closer to surface.

50 Claims, 5 Drawing Sheets

FLUID REMOVAL FROM GAS WELLS

CROSS-REFERENCE TO RELATED APPLICATIONS

This application claims foreign priority benefits under 35 U.S.C. §119 to co-pending British patent application no. GB 0227394.4, filed Nov. 23, 2002. This related patent application is herein incorporated by reference.

BACKGROUND OF THE INVENTION

1. Field of the Invention

This invention relates to removal of produced fluids from well bores, and in particular to the removal of multiple phases of fluids from well bores. Embodiments of the invention relates to the removal of natural gas and water from a natural gas-producing well.

2. Description of the Related Art

In the oil and gas production industry, and more specifically in the production of natural gas, water encroachment into the well bore which extends from the gas-producing formation to surface presents significant difficulties in maintaining production output. Where the produced fluid contains only a small proportion of water, the water will typically remain in droplet form and the velocity of the produced gas flowing from the formation into the well bore and up to surface will often be sufficient to entrain the water droplets and carry the droplets to surface.

However, as the proportion of water in the produced fluid increases, the density of the gas\water droplet column in the well bore rises. The resulting increase in hydrostatic pressure reduces the pressure gradient between the gas-producing formation and the section of well bore which intersects the formation, which may eventually kill the well.

Furthermore, the point may also be reached where the level of water production increases, or the gas velocity decreases, to a point where the velocity of the gas is not sufficient to carry the water droplets out of the well.

One temporary solution to such problems is to install velocity strings in the well bore to restrict the flow area and thus increase the velocity of the produced gas as it travels up the well. However, such velocity strings create significant flow restrictions in the well bore, thus reducing production rates. Also, the point will be reached where the velocity of the gas within the restricted area strings drops below the rate necessary to carry the water droplets to surface, and the well is again killed.

All of these problems are particularly acute in depleted wells; that is, wells which have been producing for some time, and in which the formation pressure has diminished to a level of economic or physical unfeasibility.

To overcome these difficulties it is known to employ artificial lift systems, which may be in the form of compressors or pumps which are located in the well.

SUMMARY OF THE INVENTION

According to the present invention there is provided a method of removing produced fluid from a well producing both gas and liquid, the method comprising:

utilising produced gas flowing from a formation to power a produced liquid pump; and carrying produced gas and produced liquid towards surface in separate fluid streams.

According to another aspect of the present invention there is provided apparatus for location in a well bore for use in removing produced fluid from a well producing both gas and liquid, the apparatus comprising:

a produced liquid pump for location in a well bore and adapted to be powered by produced gas flowing from a producing formation to surface; and a conduit for carrying produced liquid from the pump towards surface.

In these aspects of the invention, the use of produced gas to drive the produced liquid pump obviates the need to run a power transmission conduit from surface. Thus, there is minimal restriction in the available flow area of the bore, and a corresponding minimal reduction in the production capability of the well bore. Furthermore, in preferred embodiments of the invention there is no obstruction of the safety valve; this avoids the need to modify the well to allow installation of the apparatus, and in particular to change the location or configuration of the safety valve such that a power transmission cable or conduit may pass down through the well bore without having to pass through the safety valve. This feature also facilitates retrofitting of the apparatus in an existing well bore, as once the apparatus is run into the well bore there is no requirement for additional apparatus, such as a power supply, on surface. In other aspects of the invention, the safety valve may include provision for control lines, that is control lines may pass around rather than through the valve, and in such wells the produced liquid pump may be driven by means other than produced gas, for example the pump may be electrically powered, or powered by re-injected water. In still further embodiments, it may be acceptable for a control line to pass through the safety valve, or it may not be necessary to pump the produced liquid towards surface, for example the liquid may be pumped into another formation, rather than carried to surface.

Preferably, the separate fluid streams are co-mingled in the well bore. Carrying the gas and liquid streams separately towards surface, and then co-mingling the streams closer to surface, reduces the height of the column of liquid-carrying gas in the well bore, allowing the well to produce at a higher rate. Furthermore, as the point where the fluid streams are co-mingled is closer to surface, the gas pressure at this point will be lower and its velocity higher, such that the gas velocity should be more than sufficient to carry the liquid to surface. Also, in a preferred arrangement, the gas and liquid are co-mingled below the safety valve, increasing well safety and facilitating other operations, which require temporary isolation of the well bore from surface.

In certain embodiments of the invention the stream of produced liquid may include a gas component, to reduce the density of the liquid stream. The gas may be produced gas, or may be a gas, such as nitrogen, injected from surface.

Typically, the produced gas will be natural gas, and the produced liquid will be water. Alternatively, the liquid may be oil, or a mixture of oil and water.

The produced liquid may be liquid which has gathered in a lower portion or sump of the well bore, and a stinger may extend from the pump into this lower portion. Alternatively, or in addition, the invention may further comprise separating the produced liquid from produced gas, and then pumping the separated produced liquid to surface. The separation may be achieved by any appropriate means, such as a cyclone separator, or an arrangement which reduces the temperature of the produced gas, causing the liquid to condense. A cyclone separator is preferred as the separator also tends to separate solids from the fluid, with a resulting decrease in wear of downstream components. From the separator, the liquid may flow downwards to a sump, from which the liquid is drawn by the pump, perhaps via a stinger.

The produced liquid pump may take any appropriate form. However, the pump must of course be compact, robust and reliable. A preferred pump is a reciprocal piston pump, in which the piston reciprocates axially relative to the bore axis. Alternatively, a downhole rotary pump may be utilized. Such a pump may operate on the principle of the Archimedes screw. The pump may be a positive displacement pump. In one embodiment the pump may operate according to the Moineau principle, and may include co-operating sinusodial surfaces on both the rotor and stator of the pump, the shape of which in use allows for operation of moving cavity pumping elements.

If considered desirable or appropriate the pump may operate in combination with appropriate valving, most preferably appropriate one-way valves.

The produced liquid pump is preferably turbine-driven. The output from a turbine in these situations is likely to be high speed, low torque and thus it is preferred that the turbine is coupled to the pump via an appropriate gearbox, most preferably by a harmonic drive gearbox, which will convert the high speed, low torque input to a relatively low speed, high torque output (reduction ratios of around 100:1 are typical). The harmonic drive gearbox, which is compact, is preferably co-axial with the turbine. The pump may be a single or multi-stage axial flow pump, or a rotary pump, but as noted above it is most preferably a reciprocating pump, and thus the apparatus may comprise a mechanism for converting rotary motion to reciprocal motion. Any appropriate means may be employed, however it is preferred to utilise a series of selectively rotatable and axially movable cams such as described in GB 2219958A, WO93\11910, WO02\14028, and WO02\46564, the disclosures of which are incorporated herein by reference. The cams may be arranged and configured to provide a selected degree of axial movement, depending on the optimum throw required to operate the pump. Furthermore, the cam profiles may be selected to provide a desired pattern of movement. One or more pumps may be provided, and the pumps may be provided in series or in parallel. Pumps may be provided in series to allow access to deeper wells, in which the hydrostatic pressure experienced at the lower end of the well will be correspondingly higher. For such applications, two or more pumps, or two or more apparatus, may be provided at spaced intervals in the well bore. Thus, the liquid may be pumped from the lowermost or first pump to the second pump, and then from the second pump to the third pump, and so on. Providing two or more pumps in parallel, or two or more apparatus in parallel, improves reliability and may provide for redundancy. The outputs of the two or more pumps may be manifolded together.

As noted above, the liquid pump may be turbine driven, in which case the turbine will most likely be located adjacent the pump, and in use will likely be located towards the lower end of the bore. Other means of obtaining energy from the produced gas may be provided. Furthermore, in alternative embodiments of the invention a turbine, or other means for obtaining energy from the produced gas, may be located remote from the pump, that is closer to surface, and coupled to the pump by any appropriate means, including a mechanical linkage. Alternatively, a turbine or the like may be utilised to generate electricity or drive a hydraulic pump, and the electrical energy or hydraulic fluid may be conveyed to the pump by appropriate control lines to power the pump.

In one embodiment the produced liquid pump may be activated or deactivated when the liquid within the well reaches predetermined levels. This provides the added advantage of preventing the pump from running dry and further may reduce pump running time, thereby increasing pump life span. Activation and de-activation may be achieved by any appropriate means, including liquid level sensors operatively associated with means for switching the pump on and off.

The switching means may comprise means for coupling and decoupling pump-drive means, and in one preferred embodiment provides for coupling and decoupling of a magnetic drive of a pump-driving turbine. The coupling/decoupling means may be mechanically or electrically operated.

The conduit for carrying the produced liquid may take any appropriate form, but will typically be of a relatively small diameter conduit of jointed or continuous form. Preferably, the conduit is in the form of a "macaroni" string, having a diameter of approximately 1¼ inches.

Where there is co-mingling of the gas and liquid this will preferably take place below a subsurface safety valve (SSSV). Thus, the apparatus may be installed in a well bore without obstructing or otherwise interfering with the operation of the SSSV. Co-mingling may be achieved by providing a throttle or other restriction in the bore adjacent to the outlet of the produced liquid conduit. The restriction accelerates the gas flow and also reduces the gas pressure, thus tending to draw the liquid from the conduit, and the relatively low pressure assisting in dispersing the liquid in droplet form through the flowing gas.

Aspects of the invention may also be utilised where it is desired to bullhead or restart a well that has already been killed by water ingress. This may be achieved by pumping gas into the well to force the water which has gathered in the well bore back into the formation. The well is then allowed to produce back, initiating the method as described above.

An alternative method of restarting a flooded well is to position the apparatus within the well and then pressure up the well with gas. The pressure build up within the well will cause the water collected within the well to be forced to the surface via the apparatus. Gas may be injected into the well until the well is dry. Thereafter, the well is allowed to produce, initiating the method as described above.

The gas injection may be carried out while the liquid pump is still coupled to a running tubular, and the water forced to the surface may pass through one or both of the running tubular or the conduit. Once the well is dry, the apparatus may be hung in the well, the running tubular retrieved, and the well allowed to produce.

Further aspects of the invention relate to a downhole pump in which a rotary drive is utilised to actuate a reciprocating pump. The rotary drive may be a turbine, or any other appropriate drive means, such as an electric motor. The pump may take any appropriate form, but is preferably a reciprocating piston pump. The pump may include appropriate gearing, most preferably in the form of a harmonic drive. The conversion of rotary drive to reciprocating motion may be achieved by any appropriate mechanism, but most preferably utilises a series of selectively rotatable and axially translatable cams and cam followers. The number and configuration of the cams may be selected to provide a desired degree of movement, with the capability to multiply up the movement produced. The pump may be positively driven in both directions, or may utilise a spring or pressure return.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

These and other aspects of the present invention will now be described, by way of example, with reference to the accompanying drawings, in which.

DETAILED DESCRIPTION OF THE PREFERRED EMBODIMENT

Figure 1:
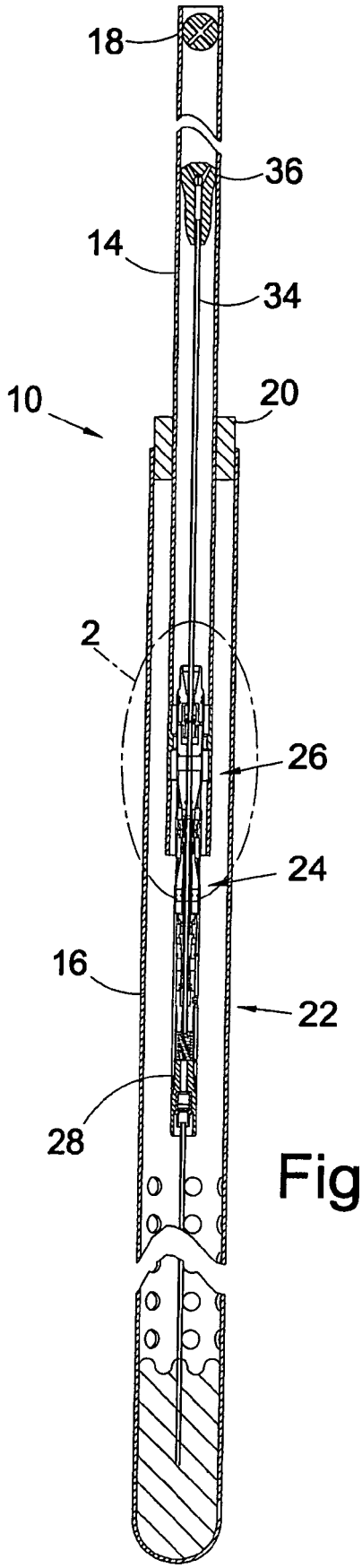
FIG. 1 is a schematic sectional view of apparatus for use in removing fluid from a well producing both natural gas and water, in accordance with a preferred embodiment of the present invention.
Figure 2:
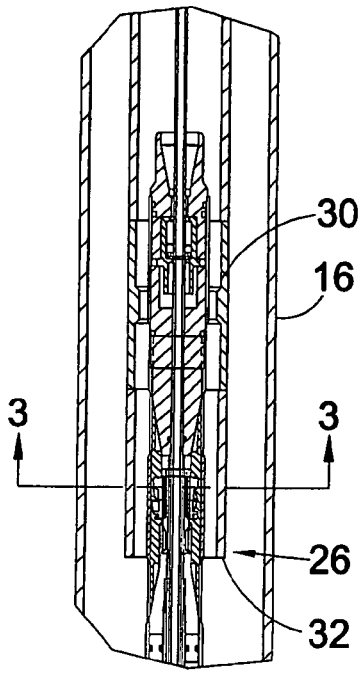
FIG. 2 is an enlarged view of area 2 of FIG. 1.
Figure 3:
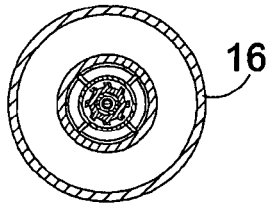
FIG. 3 is a sectional view on line 3—3 of FIG. 2.

Reference is first made to FIGS. 1, 2 and 3 of the drawings, which illustrates apparatus 10 located in a well bore, for removing gas and water from the well. The Figure illustrates various well components including a section of completion or production tubing 14 which extends into a section of perforated liner 16. The liner 16 intersects a natural gas and water-producing formation (not shown). A self-closing sub-surface safety valve (SCSSSV) 18 is located at the upper end of the completion tubing 14 and the tubing 14 is located and sealed relative to the liner 16 by an appropriate packer 20.

In use, the apparatus 10 is used to facilitate the production of natural gas and water form the well. To this end the apparatus 10 includes a pump assembly 22 which is driven, via a reduction gearbox 24, by a produced gas-driven turbine 26. The turbine 26, gearbox 24 and pump assembly 22 are coupled together to form an elongate cylindrical unit 28 which is located relative to the lower end of the production tubing 14 by a suitable nipple 30 and tubing shoe 32.

A macaroni string 34 extends upwards from the unit 28, through the production tubing 14, carrying produced water from the pump 22. The produced gas, after passing through the turbine 26, passes up through the production tubing 14 separately of the gas stream. A co-mingling and hang-off sub 36 is provided at the top of the macaroni string 34 for locating the upper end of the string 34 in the tubing 14 and such that the water leaving the upper end of the string 34 co-mingles with the gas stream in the tubing 14. The gas, with the water entrained in droplet form, then passes upwardly through the SCSSSV 18, and on to surface, where the gas and water may be separated.

Figure 5:
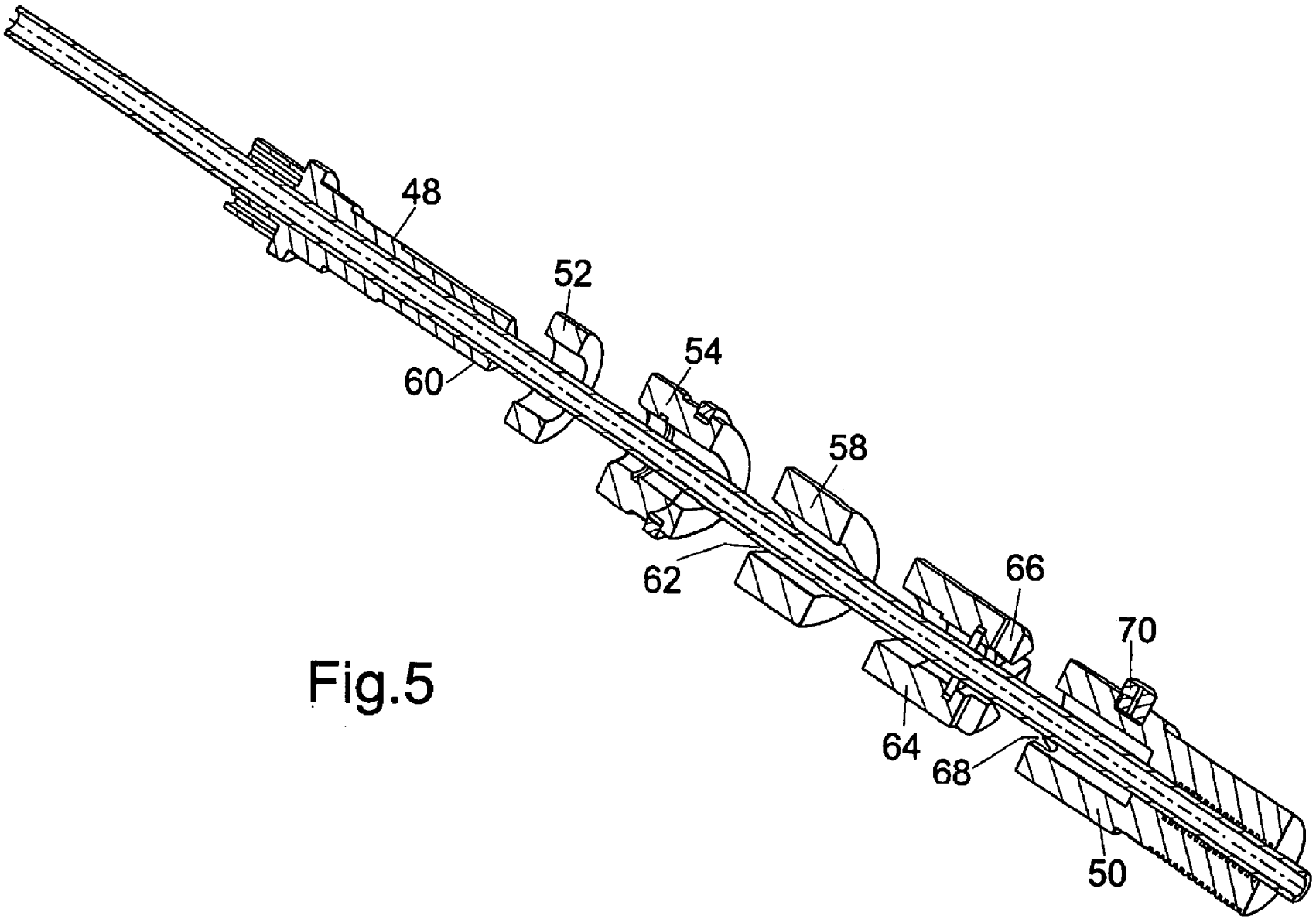
FIG. 5 is an enlarged exploded view showing components of a pump assembly of the apparatus of FIG. 1.
Figure 6:
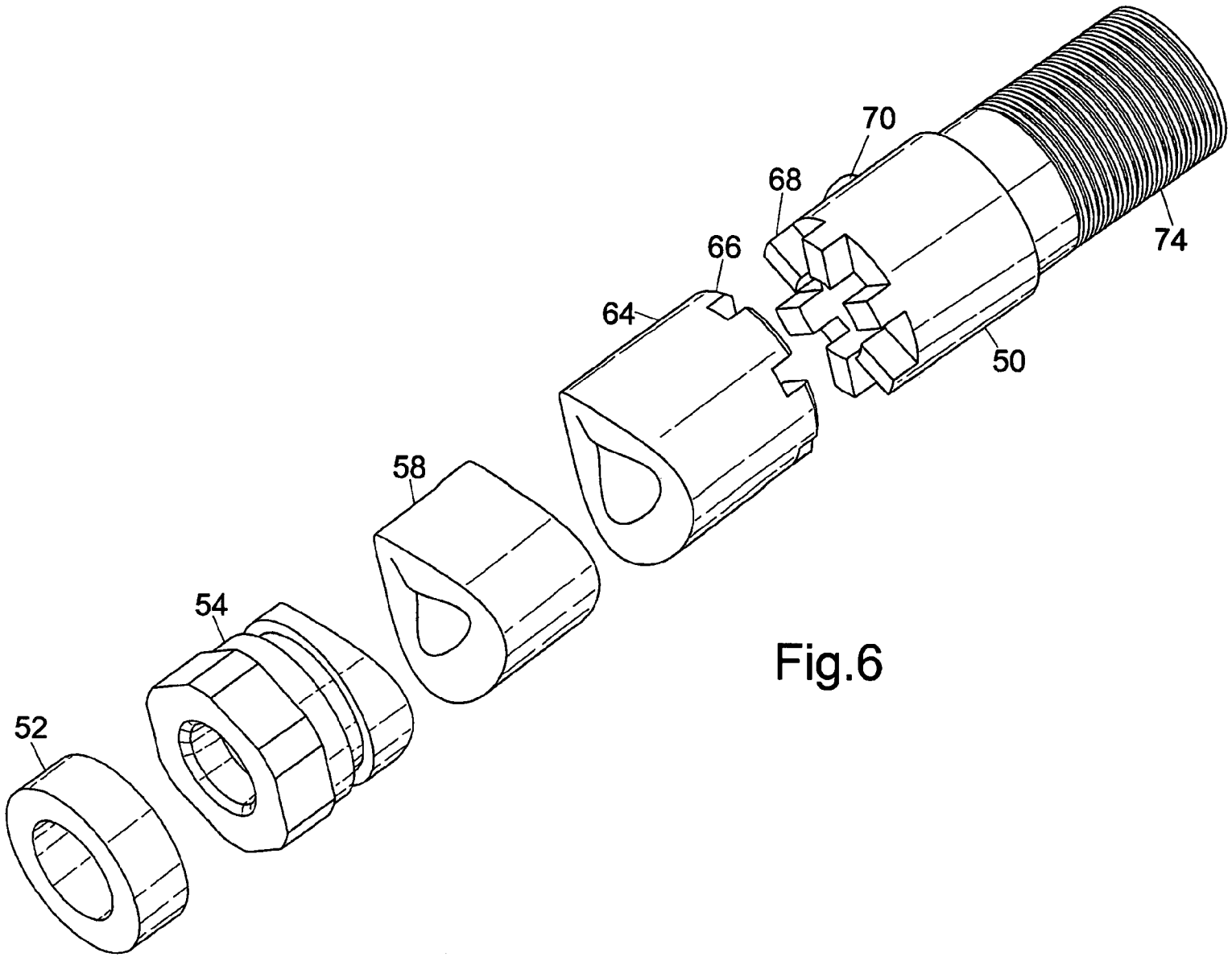
FIG. 6 is a view of a number of the components shown in FIG. 5.

Details of the apparatus 10 will now be described with reference to FIGS. 4 to 6, which illustrate the unit 28 with the macaroni string 34 extending from the upper end thereof, and with a stinger 38 extending from the lower end of the unit 28. In use, the open lower end of the stinger 38, which includes a filter pack to filter out solids, is located within a volume of water 40 lying in the sump of the well (see FIG. 1).

The unit 28 is located in the tubing shoe 32 such that produced gas flowing from the liner 16 into the production tubing 14 has to pass through the turbine 26, where the gas impinges on the turbine blades 42. The passage of the gas through the turbine 26 tends to dry the gas, as the expansion and cooling experienced by the gas as it passes through the turbine 26 tends to cause water carried by the gas to condense out; this condensate will coalesce and then fall to the sump.

The turbine rotor 44 is mounted on a hollow drive shaft 46 mounted centrally and coaxially of the unit, the shaft 46 extending downwardly into the gearbox 24, which is in the form of a harmonic drive. Accordingly, the harmonic drive is co-axial with the turbine 26 and changes the output of the turbine 26 from a high speed low torque output, to a low speed high torque output. The hollow gearbox output drive shaft 48 extends into the pump assembly 22, components of which are illustrated in exploded format in FIGS. 5 and 6 of the drawings.

The pump assembly 22 includes an arrangement for converting the rotary drive output of the gearbox 24 into reciprocal motion, to drive a reciprocating piston 50. The gearbox output shaft 48 is mounted in a bearing 52 and passes through a static annular cam 54 which is locked axially and rotatably relative to the housing 56 of the unit 28. Located below the static cam 54 is a drive cam 58, which is axially movable on the drive shaft 48. However, the drive cam 58 is rotatably locked relative to the drive shaft 48 by virtue of the co-operating hexagonal forms 60, 62 of the drive shaft 48 and drive cam 58. Positioned below the drive cam 58 is an output cam 64 which is axially movable within the housing 56 but is prevented from rotating by its interaction with the piston 50, via co-operating castellations 66, 68.

The piston 50 is itself axially movable in the housing 56 but is locked against rotation by the interaction of a radially extending piston location pin 70 with a corresponding axial slot 72 in the housing 56. The piston 50 defines a through bore and the lower end of the piston carries a labyrinth seal 74.

Rotation of the drive shaft 48 causes the drive cam 54 to rotate. The sine wave-like forms of the abutting faces of the static cam 54 and the drive cam 58 cause the rotating drive cam 58 to move axially relative to the static cam 54 and the housing 56 between a position in which the troughs and peaks of the cam surfaces coincide, and a position in which the peaks of the surfaces coincide. Similarly, the sine wave form of the abutting faces of the drive cam 58 and the output cam 64 cause the non-rotating output cam 64 to be moved axially as the drive cam 58 is rotated. The cam faces are oriented and arranged such that the initial axial movement of the drive cam 58 induced by the rotation of the drive cam 58 relative to the static cam 54 is amplified by the relative rotational movement between the drive cam 58 and the output cam 64, this amplified axial movement being transferred to the piston 50.

Figure 4:
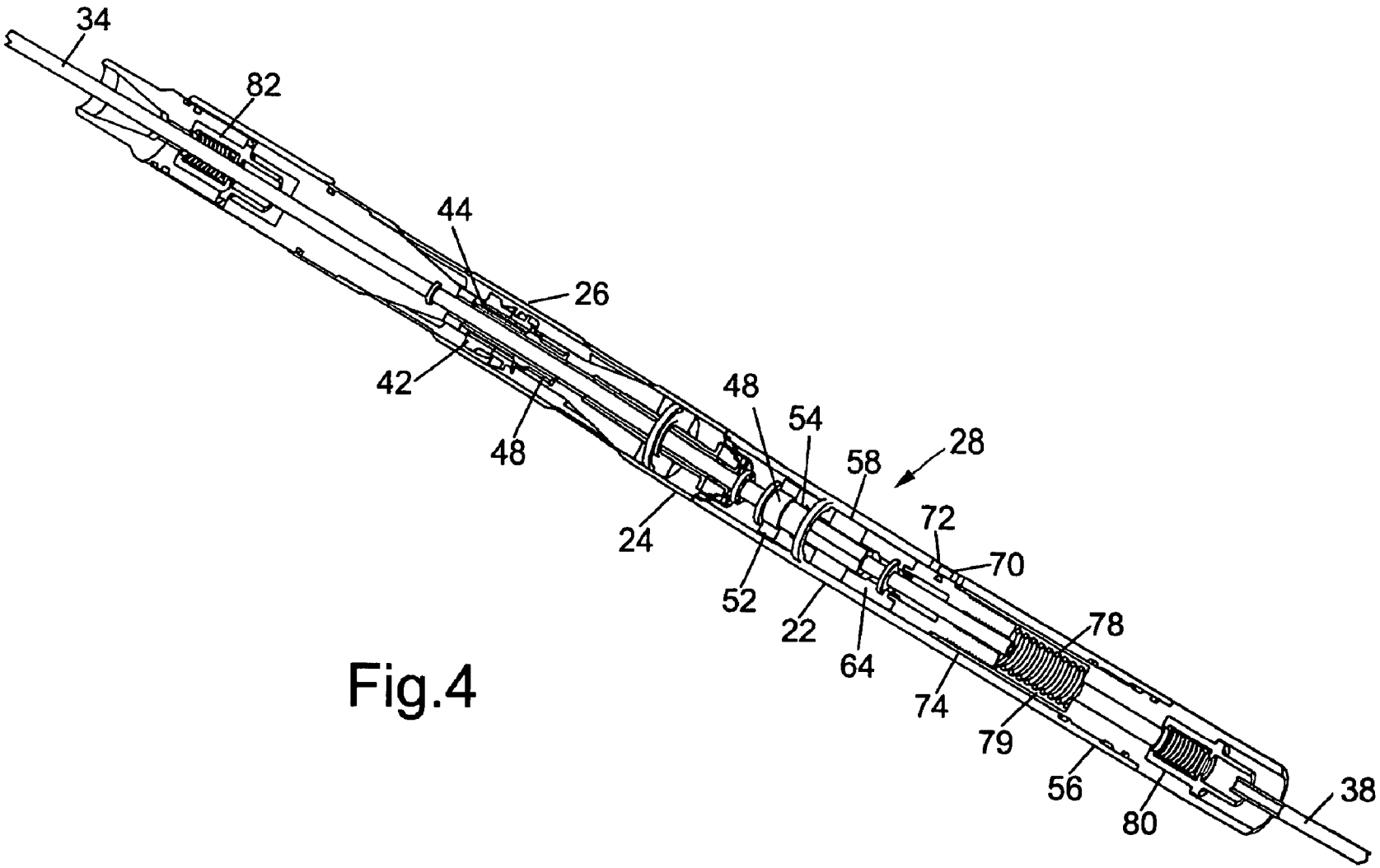
FIG. 4 is an enlarged sectional view of part of the apparatus of FIG. 1.

The piston 50 is urged towards an upper or induction position by a light compression spring 78, such that as the drive shaft 48 is rotated the piston 50 moves, from the position shown in FIG. 4, downwardly against the spring 78. The piston 50 acts on a volume of water below the piston, in the spring chamber 79, the water being prevented from passing downwardly out of the chamber 79 through the stinger 38 by a one-way valve 80, but being permitted to pass from the upper end of the unit 28 via a second one-way valve 82, which opens when the water pressure within the pump rises to a level above hydrostatic pressure (typically around 3000 psi). Movement of the piston 50 in the opposite direction, that is upwards within the housing 56, reduces the pressure across the upper valve 82, such that the valve 82 closes, and allows the lower valve 80 to open, such that the water may be drawn into the spring chamber 79 through the stinger 38. It will be noted that the cam faces are arranged such that each rotation of the gearbox output shaft 48 will result in two full strokes of the piston 50.

Thus, the passage of production gas from the producing formation, up through the well bore, drives the turbine 26 which in turn drives the pump unit 22, which causes water to be drawn up from the sump and pumped towards surface through the macaroni string 34. Thus, the produced gas and the produced liquid move towards the surface in separate streams, until reaching the co-mingling and hang-off sub 36. The restriction in the flow area of the gas caused by the sub 36 accelerates the gas stream, and also reduces the pressure of the gas stream. This assists in drawing the water from the upper end of the string 34, such that the water, in droplet form, is carried upwardly from the end of the string 34 through the upper end of the tubing 14, and through the SCSSSV 18, by the produced gas stream.

The apparatus 10 has a relatively small diameter and thus may be accommodated in smaller diameter well bores, and indeed may be readily retrofitted into an existing well, and subsequently removed if necessary. The volume of water raised to surface by the apparatus is likely to be relatively small (typically below 24 barrels per day), however this can still have a significant impact on a well and can extend the life of a well, or increase production in a well, at relatively low cost.

Figure 7:
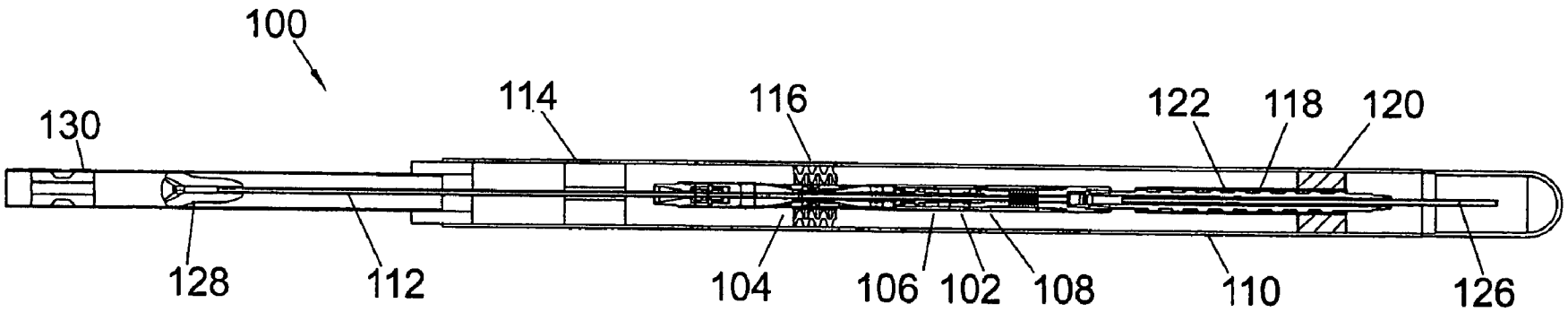
FIG. 7 is a schematic sectional view of apparatus for use in removing fluid from a well producing both natural gas and water, in accordance with a further embodiment of the present invention.

Reference is now made to FIG. 7 of the drawings, which illustrates an alternative apparatus 100 in accordance with a further embodiment of the present invention. The apparatus 100 is similar to the apparatus 10 described above, but has the unit 102 containing the turbine 104, gearbox 106, and pump unit 108 located wholly within the liner 110, and the lower end of the macaroni string 112 located relative to the liner 110 by appropriate slips 114. Accordingly, in order to direct the produced natural gas through the turbine 104, a restriction 116 is positioned around the turbine 104.

The apparatus 100 also further includes a gas/water cyclone separator 118. A porous pack-off bushing 120 positioned around the lower end of the separator 118 directs the □wet□ gas from the producing formation into the lower end of the separator 118. The gas is directed upwards through the separator 118 in a helical path, such that heavier material, in particular any solids and water droplets, are thrown outwardly to coalesce and pass through the perforated lower section of the separator housing 122. The water may then flow downwards to the sump, through the porous bushing 120.

The dry gas passes out of the upper end of the separator 118 and is directed through the turbine 104. The output of the turbine drives the pump unit 108, via the gearbox 106, such that water is drawn out of the sump via the stinger 126, and pumped upwards through the string 112. At the co-mingling sub 128 the separate water and gas streams are combined, and pass up through the SCSSSV 130 to surface.

It will be apparent to those of skill in the art that the above-identified embodiments of the invention are merely exemplary, and that various modifications and improvements may be made thereto, without departing from the scope of the present invention. For example, in the embodiments described above only one apparatus 10, 100 is provided in the well. In other embodiments, particularly for use in deeper well, two or more apparatus may be provided in a well. The apparatus may be provided in series, that is the produced gas is utilised to drive a first produced liquid pump at the lower end of the well bore, and from which the liquid is pumped part-way up the well bore to a second apparatus. At the second apparatus, the produced gas is again employed to drive a turbine which in turn drives a pump to take the liquid further up the well bore. In other embodiments, two or more apparatus may be connected in parallel, that is the produced liquid outputs of the two or more pumps will be manifolded together. Two or more groups of such apparatus may be provided in series, as described above. Providing apparatus in parallel may improve reliability particularly if some redundancy is built in to the system. Thus, if one apparatus should fail, the remaining apparatus will continue to operate and maintain production.

In still further embodiments a turbine or the like may be provided closer to surface, for example a short distance below the SCSSSV, and utilised to generate electricity which is relayed to the pump via appropriate cabling. While there is likely to be less energy in the produced gas at this location, the greater gas volume and velocity, and lower gas temperature, may facilitate turbine operation.

In still further embodiments, a relatively long stinger may be provided, allowing the pump assembly to be located further up the well, for example above the packer 20. This would facilitate provision of a pump assembly of longer dimensions.

While the foregoing is directed to embodiments of the present invention, other and further embodiments of the invention may be devised without departing from the basic scope thereof, and the scope thereof is determined by the claims that follow.

The invention claimed is:

1. A method of removing produced fluid from a well producing both gas and liquid, the method comprising:

operating a produced liquid pump by flowing produced gas through a drive member of the pump, wherein the formation supplies the produced liquid and the produced gas; and carrying the produced liquid from the pump and the produced gas towards surface in separate fluid streams.

2. The method of claim 1, further comprising co-mingling the separate fluid streams.

3. The method of claim 2, wherein the fluid streams are co-mingled below a sub-surface safety valve.

4. The method of claim 2, further comprising restricting the gas stream before co-mingling the separate gas and liquid streams.

5. The method of claim 1, comprising running the pump and a conduit into an existing well bore.

6. The method of claim 1, wherein the produced gas comprises natural gas.

7. The method of claim 1, wherein the produced liquid comprises water.

8. The method of claim 1, wherein the produced liquid comprises oil.

9. The method of claim 1, wherein produced liquid is drawn from a lower portion of the well bore.

10. The method of claim 1, further comprising separating produced liquid from produced gas, and then pumping the separated produced liquid towards surface.

11. The method of claim 10, wherein the separated produced liquid flows downwards to a sump, from which the liquid is drawn by the pump.

12. The method of claim 1, further comprising utilizing the produced gas to drive at least two produced liquid pumps.

13. The method of claim 12, wherein the at least two produced liquid pumps are connected in series.

14. The method of claim 1, comprising utilizing the produced gas flowing adjacent the pump to power the pump.

15. The method of claim 14, comprising utilizing the produced gas to drive a turbine.

16. The method of claim 15, comprising mechanically coupling the turbine to the pump.

17. The method of claim 1, further comprising:

pumping gas into the well to force liquid lying in the well back into the formation; then allowing gas to flow from the formation to drive the pump.

18. The method of claim 1, further comprising pumping gas into the well to displace liquid in the well towards surface.

19. The method of claim 1, further comprising retrieving the pump and a conduit from the well bore.

20. A method of bullheading a gas producing well containing liquid, the method comprising:

pumping gas into a well to displace liquid lying in the well towards surface;

allowing produced gas to flow from the formation and operating a produced liquid pump by flowing the produced gas through a drive member of the pump once the level of liquid in the well has fallen below a predetermined level; and carrying gas and liquid from the pump towards surface in separate fluid streams.

21. Apparatus for location in a well bore for use in removing produced fluid from a well producing both gas and liquid, the apparatus comprising:

a produced liquid pump for location in a well bore and adapted to be powered by produced gas flowing from a producing formation;

a stinger for extending into a lower portion of the well; and a conduit for carrying produced liquid from the pump towards surface.

22. The apparatus of claim 21, further comprising means for co-mingling produced liquid from the conduit with gas in the well bore.

23. The apparatus of claim 21, wherein the means for co-mingling produced liquid from the conduit with gas in the well bore comprises a restriction in the bore adjacent an upper end of the produced liquid conduit.

24. The apparatus of claims 21, further comprising a separator for separating produced liquid from produced gas.

25. The apparatus of claim 24, wherein the separator is a cyclone separator.

26. The apparatus of claim 21, wherein the produced liquid pump is a reciprocal piston pump.

27. The apparatus of claim 26, further comprising at least two one-way valves, allowing liquid to be drawn into and then pumped from the pump.

28. The apparatus of claim 21, wherein the produced liquid pump is a rotary pump.

29. The apparatus of claims 21, further comprising a turbine for driving the produced liquid pump.

30. The apparatus of claim 21, comprising a turbine for converting the kinetic energy of the produced gas to mechanical power.

31. The apparatus of claim 30, wherein the turbine is mechanically coupled to the produced liquid pump.

32. The apparatus of claim 30, further comprising a generator for coupling to an output of the turbine.

33. The apparatus of claim 30, further comprising means for generating electrical energy from the mechanical power output from the turbine, and an electric motor for driving the produced liquid pump.

34. The apparatus of claim 30, wherein the turbine is adapted for location on the well adjacent the produced liquid pump.

35. The apparatus of claim 30, wherein the turbine is adapted for location in the well remote from the produced liquid pump.

36. The apparatus of claim 21, wherein the conduit for carrying the produced liquid is a macaroni string.

37. The apparatus of claim 21, wherein the pump further comprises means for selectively activating and deactivating the pump.

38. The apparatus of claim 37, wherein the means for activating and deactivating the pump comprises a drive coupling between the pump and a turbine.

39. The apparatus of claims 21, further comprising at least one further produced liquid pump for location in the well bore and adapted to be powered by produced gas.

40. The apparatus of claim 39, wherein the produced liquid pumps are connected in series.

41. A method of removing produced fluid from a well producing both gas and liquid, the method comprising:

utilizing produced gas flowing from a formation to drive at least two produced liquid pumps, wherein the at least two produced liquid pumps are connected in parallel; and carrying the produced liquid from the pumps and the produced gas towards surface in separate fluid streams.

42. An apparatus for location in a well bore for use in removing produced fluid from a well producing both gas and liquid, the apparatus comprising:

a produced liquid pump for location in a well bore and adapted to be powered by produced gas flowing from a producing formation, wherein the pump is provided in combination with a gearbox; and a conduit for carrying produced liquid from the pump towards surface.

43. The apparatus of claim 42, wherein the gearbox is a harmonic drive gearbox.

44. The apparatus of claim 42, wherein the gearbox is co-axial with a turbine for driving the produced liquid pump.

45. An apparatus for location in a wellbore for use in removing produced fluid from a well producing both gas and liquid, the apparatus comprising:

a produced liquid pump for location in a well bore and adapted to be powered by produced gas flowing from a producing formation wherein the pump is a reciprocating pump;

a mechanism for converting a rotary drive to reciprocal motion; and a conduit for carrying produced liquid from the pump towards surface.

46. The apparatus of claim 45, wherein the mechanism for converting rotary drive to reciprocal motion comprises a series of selectively rotatable and axially movable cams mounted about a mandrel.

47. An apparatus for location in a well bore for use in removing produced fluid from a well producing both gas and liquid, the apparatus comprising:

a produced liquid pump for location in a well bore and adapted to be powered by produced gas flowing from a producing formation;

a magnetic drive coupling between the pump and a turbine for selectively activating and deactivating the pump; and a conduit for carrying produced liquid from the pump towards surface.

48. Apparatus for location in a well bore for use in removing produced fluid from a well producing both gas and liquid, the apparatus comprising:

a first produced liquid pump for location in a well bore and adapted to be powered by produced gas flowing from a producing formation;

a second produced liquid pump for location in the well bore and adapted to be powered by produced gas, wherein the produced liquid pumps are connected in parallel; and a conduit for carrying produced liquid from the pump towards surface.

49. A method of kicking off a gas-producing well containing a liquid, the method comprising:

pumping a gas into the well to force the liquid lying in the well back into a formation;

allowing the gas and a produced gas to flow from the formation and operating a produced liquid pump by flowing the gas and the produced gas through a drive member of the pump; and carrying gas, and liquid from the pump, towards surface in separate fluid streams.

50. The method of claim 49, further comprising co-mingling the separate fluid streams.

* * * * *